US008074668B2

(12) United States Patent
Alexander et al.

(10) Patent No.: US 8,074,668 B2
(45) Date of Patent: Dec. 13, 2011

(54) PRESSURE WASHER WITH DIAGNOSTIC INDICATORS

(75) Inventors: Gus Alexander, Inverness, IL (US); Mike Hanson, Lakewood, IL (US)

(73) Assignee: FNA IP Holdings, Inc., Elk Grove Village, IL (US)

( * ) Notice: Subject to any disclaimer, the term of this patent is extended or adjusted under 35 U.S.C. 154(b) by 1490 days.

(21) Appl. No.: 10/790,527

(22) Filed: Mar. 1, 2004

(65) Prior Publication Data

US 2005/0189437 A1 Sep. 1, 2005

(51) Int. Cl.
*B08B 3/00* (2006.01)

(52) U.S. Cl. ..... 134/113; 134/58 R

(58) Field of Classification Search ..... 134/113
See application file for complete search history.

(56) References Cited

U.S. PATENT DOCUMENTS 4,697,464 A * 10/1987 Martin ..... 73/866.3
5,040,950 A * 8/1991 Dalquist et al. ..... 417/234
5,220,935 A 6/1993 Bailey et al.
5,381,962 A * 1/1995 Teague ..... 239/526
5,661,623 A 8/1997 McDonald et al.
5,745,043 A * 4/1998 Lemke et al. ..... 340/815.4
5,749,526 A * 5/1998 Laabs et al. ..... 239/307
5,757,162 A * 5/1998 Weber ..... 318/821

FOREIGN PATENT DOCUMENTS

DE 227568 A * 9/1985
DE 100 29 375 A1 3/2002

OTHER PUBLICATIONS

U.S. Patent & Trademark Office, International Search Report in International Patent Application No. PCT/US2005/006570 (Dec. 18, 2006).
EP Supplementary Search Report for EP Application No. EP 05724165 dated Jul. 15, 2011.

* cited by examiner

*Primary Examiner* — Michael Barr
*Assistant Examiner* — Jason Riggleman
(74) *Attorney, Agent, or Firm* — Cook Alex Ltd.

(57) ABSTRACT

An electrical pressure washer includes a diagnostic circuit for detecting operation conditions that may affect the normal operation of the pressure washer, and a plurality of indicators indicating the detected operation conditions, such as ground fault, low pressure, overheating, etc. A voltage drop across the power cord of the pressure washer is monitored and used to identify several of the operating conditions. A way of connecting and controlling light-emitting diodes used as indicator lights is provided to allow energy-efficient operation of the indicator lights.

21 Claims, 8 Drawing Sheets

PRESSURE WASHER WITH DIAGNOSTIC INDICATORS

TECHNICAL FIELD

This invention relates generally to pressure washers, and more particularly to a pressure washer that has indicators for indicating operating conditions of the pressure washer to provide diagnostic information to a user.

BACKGROUND OF THE INVENTION

A pressure washer is a device that outputs a high-pressure jet of water that can be used to wash surfaces such as wood, tile, concrete, etc. Many pressure washers are powered by electricity and designed for household and light commercial use. Such an electrical pressure washer typically includes an electrical motor for pressurizing water from a low-pressure source (e.g., a garden hose) to a much higher pressure. The pressurized water then goes through a flexible hose to an application wand (or lance), which is fitted with a nozzle with a fixed or variable aperture and has a trigger for turning high-pressure water jet on or off. To enhance the cleaning power of the water stream, some pressure washers have a chemical tank for storing a liquid detergent and have an operation mode in which the detergent is extracted from the tank by means of vacuum suction and mixed into the water stream.

Although an electrical pressure washer is a relatively simple device, its operation may be affected by various conditions and may appear to an inexperienced user to be malfunctioning even if the machine is actually in good shape. For instance, an electrical pressure washer may be required by safety code or regulations to be equipped with a ground fault circuit interrupter (GFCI) for protecting a user from electrical shocks. A GFCI, however, may sometimes be accidentally tripped, and the AC power to the motor will be cut off as a result. In such a situation, the pressure washer can be put back in operation by simply resetting the GFCI. Nevertheless, an inexperienced user who is unaware of the existence and/or function of the GFCI may think that pressure washer is broken. As another example, when the pressure washer is put in the chemical suction mode, the pressure of the water jet is significantly lower than that in the normal operation mode. A user, however, may not know or remember to check that the pressure washer is in the chemical suction mode and may jump to the conclusion that the pressure washer is defective. Also, the pressure washer will not work properly if the AC voltage supplied to it is low, which may happen if the user plugs the pressure washer into a long extension cord, which introduces a substance voltage drop due to the large amount of current drawn by the pressure washer.

Thus, inexperienced users often find it difficult to identify the reasons why their electrical pressure washers do not work as expected. Such difficulties present a serious problem to the manufacturer of the pressure washers due to the increased cost for providing consumer services. When a user plugs in a newly purchased pressure washer and does not get the expected high-pressure water jet, he may think that the machine is defective and decide to return it to the store where he bought it. The allegedly bad machine is then returned the manufacturer even if it is fully functional. A user may also call in for service under warranty when his pressure washer stops pumping water. As a result, a service technician may have to be dispatched to service the machine in the field, even if the problem can be simply corrected by resetting the GFCI switching from the chemical suction mode to the normal operation mode, or removing the extension cord, etc.

SUMMARY OF THE INVENTION

In view of the foregoing, it is a general goal of the invention to provide a way to enable a user of an electrical pressure washer to properly identify the possible reasons why the pressure washer is not functioning as expected.

It is a related goal of the invention to provide means for assisting the user in checking important operation conditions that affect the operation of the pressure washer, so that the user can quickly and easily identify the possible cause for the apparent malfunction of the pressure washer, and take appropriate measures to correct the problem.

The foregoing objects are achieved by the invention, which provides an electrical pressure washer that has a diagnostic circuit for detecting operation conditions that may affect the normal operation of the pressure washer, and has indicators for indicating the operation conditions to the user to assist the user in diagnosing potential problems when the pressure washer is not operating normally. With the operation condition indicators, the user may be able to identify the condition that causes the apparent malfunction of the pressure washer, and correct the problem by himself. Alternatively, the user may contact the technical service of the manufacturer/seller of the pressure washer and identify the operation conditions as indicated by the indicators on the pressure washer, and receive instructions to correct the problem if the problem can be easily corrected by the user.

DETAILED DESCRIPTION OF THE INVENTION

Figure 1:
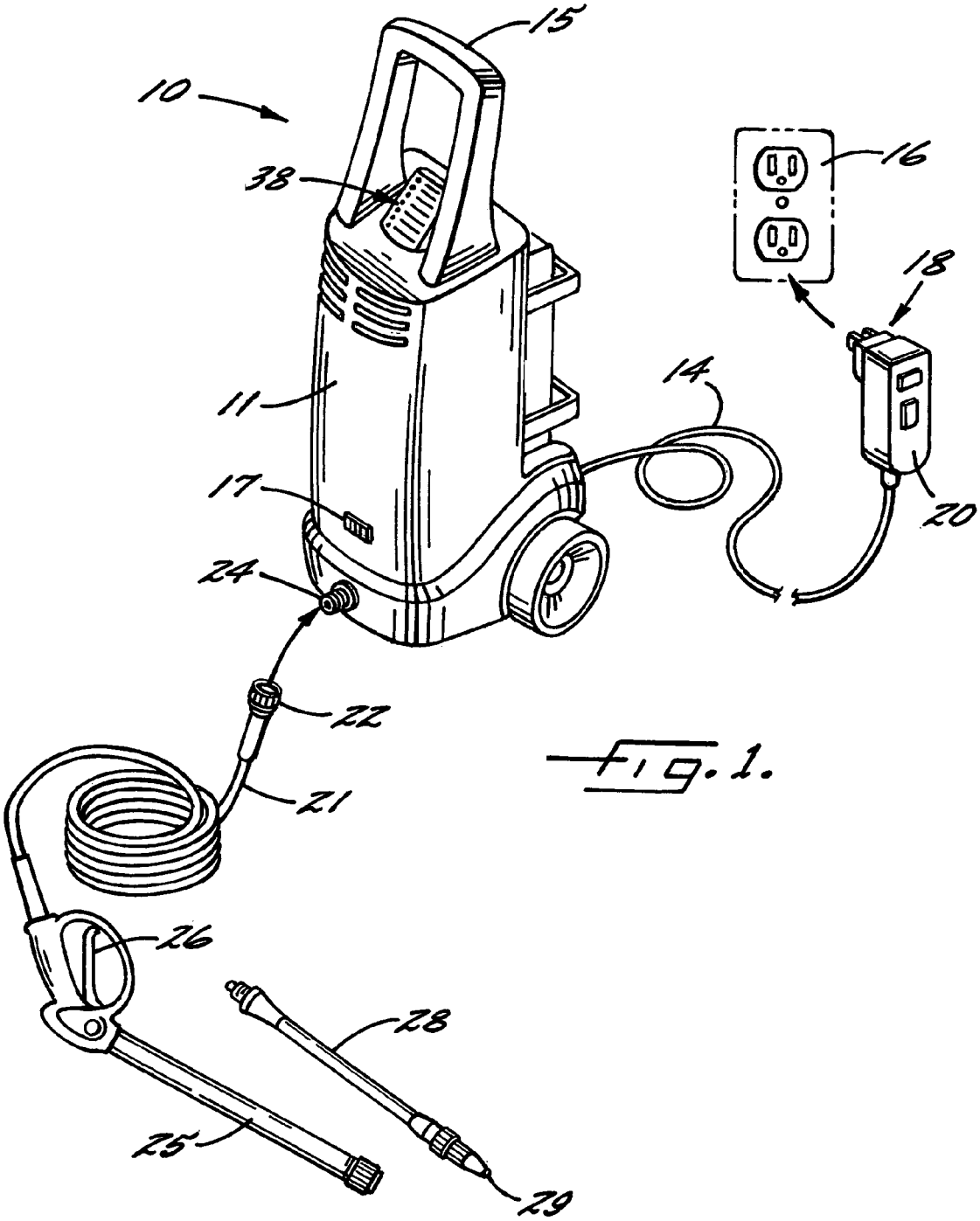
FIG. 1 is a perspective view of an electrical pressure washer that implements an embodiment of the invention for detecting operation conditions of the pressure washer and indicating the detected conditions to a user for diagnostic/problem-shooting purposes.

Turning to the drawings and referring first to FIG. 1, an electrical pressure washer 10 in an embodiment of the invention includes a housing 11 that contains an electrical motor 12

(FIG. 2) for pressurizing water received from a low-pressure water source through a water inlet 13 (FIG. 2) to provide an output high-pressure water stream. A power cord 14 of a pre-selected length connects the pressure washer to an AC outlet 16 from which the pressure washer draws the power needed for operating the motor. An on/off switch 17 on the housing 11 of the pressure washer is used to turn the pressure washer on or off by connecting or breaking the AC power to the motor. On the distal end of the power cord 14 is an AC plug 18 to be plugged into a receptacle of the AC outlet 16. In the illustrated embodiment, the power cord includes a ground fault circuit interrupter (GFCI) 20 that is integrated with the AC plug 18. The GFCI is not required, however, in regions where the electrical safety code does not call for such a device. The pressure washer 10 further includes a flexible high-pressure hose 21. One end of the pressure hose has a connector 22 that can be connected to a fitting 24 on the housing to form a leak-proof connection. The other end of the hose 21 is connected to an application wand 25 with a trigger 26 for opening or closing a valve in the wand to control the water flow. The pressure washer further includes a nozzle 28 that can be connected to the wand 25 such that pressurized water is ejected through an output opening 29 of the nozzle when the user pulls the trigger 26 on the wand 25. The size of the output opening 29 of the nozzle 28 is preferably adjustable to allow the pressurized water stream coming out of the nozzle to be adjusted from a wide "fan" spray to a focused pencil-thin stream.

Figure 2:
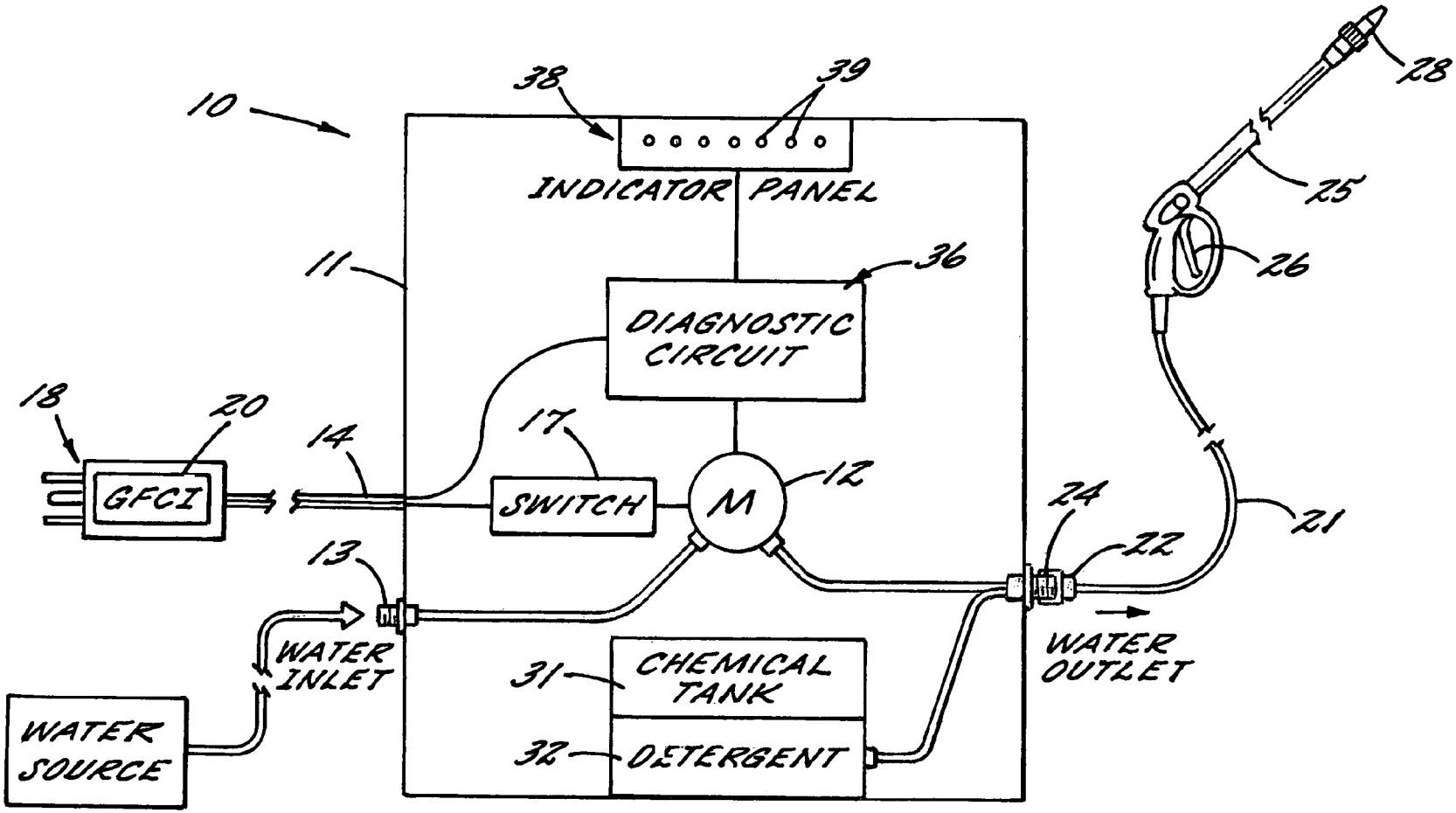
FIG. 2 is a schematic functional diagram that identifies components of the electrical pressure washer.

Referring now to FIG. 2, to provide enhanced clearing power of the pressurized water stream, liquid detergent or the like may be added to the water stream. To that end, the pressure washer includes a chemical tank 31 for containing the liquid detergent 32. A vacuum generated by the pressurized water pumped out through the nozzle 28 is used to provide suction of the detergent from the chemical tank. The detergent extracted by the vacuum from the chemical tank is mixed with the water stream and ejected through the nozzle 28. When the pressure washer is put in the chemical suction mode, the pressure of the water stream ejected through the nozzle is significantly lower than that when the pressure washer is in the normal operation mode.

As mentioned before, the operation of the pressure washer 10 is affected by various factors, and there are multiple conditions that will make the pressure washer appear that it is not function properly. Such conditions are often difficult to understand or identify by an inexperienced user who has not read the manual for the pressure washer or cannot comprehend the explanations and instructions in the manual. As a result, the user tends to assume that the pressure washer is broken or faulty, even though some of the conditions affecting the performance of the machine can be easily corrected. For instance, if the GFCI 20 on the plug 18 of the power cord is tripped, AC power is cut off at the plug end of the power cord, and the pressure washer 10 cannot be turned on by operating the on/off switch 17 on the housing. Also, if the user inserts a long extension cord between the pressure washer and the AC wall outlet 16 instead of plugging the power cord directly into the wall outlet, a substantial voltage drop may develop across the extension cord due to the resistance of the extension cord and the large amount of current drawn by the motor 12 of the pressure washer. As a result, the voltage seen by the motor is significantly lower than the standard AC voltage, causing the pressure of the water stream to drop noticeably. Moreover, a user may forget that the washer is put in the chemical suction mode, and view the weaker water stream in that mode as a sign that there is something wrong with the pressure washer. Such inability of the user to identify the true problems causing the pressure washer to stop working normally can incur tremendous overheads for the manufacturer or distributor of the pressure washer in handling unnecessary returns or providing field service for conditions that can be easily corrected.

Figure 3:
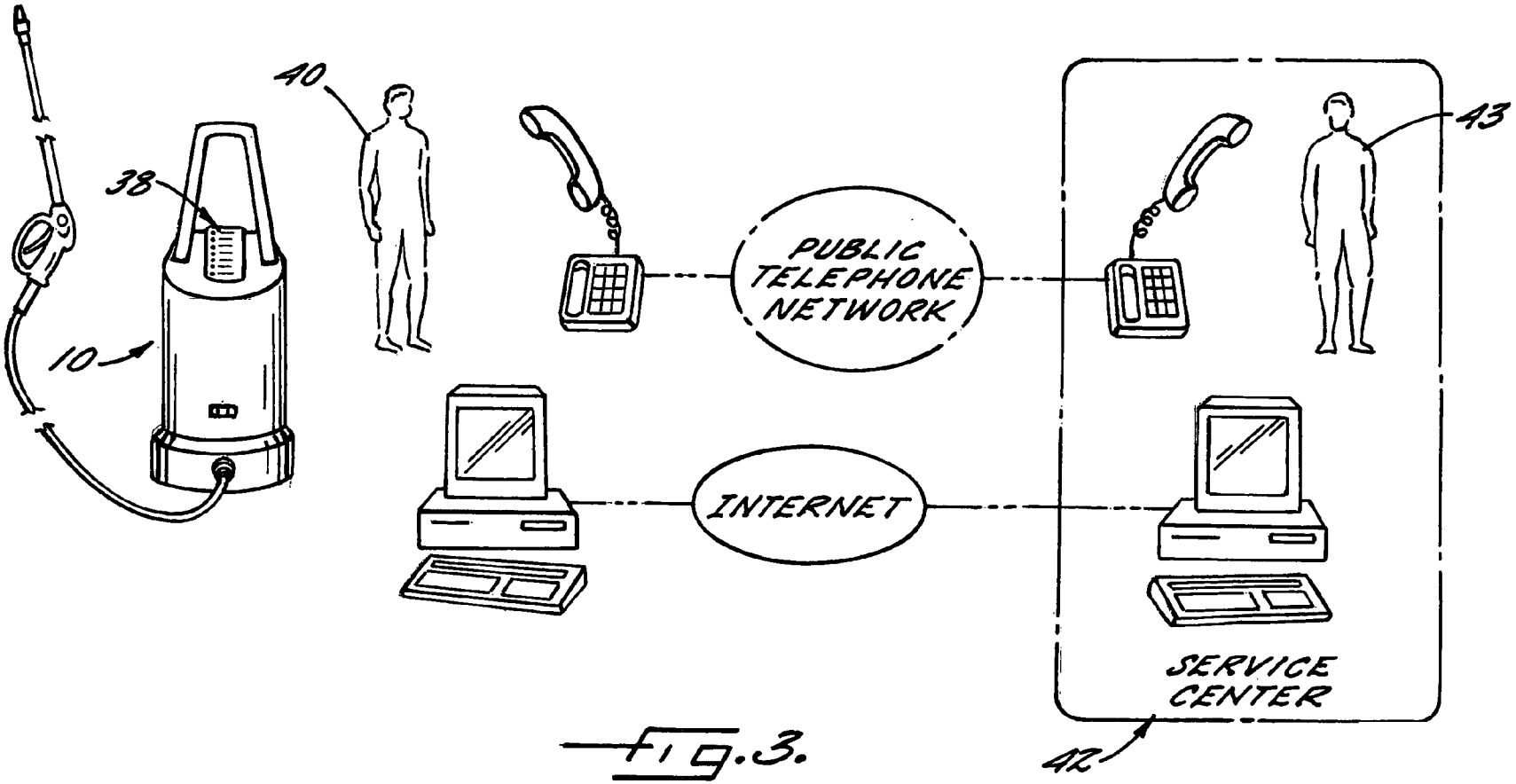
FIG. 3 is a schematic diagram depicting a user of the electrical pressure washer contacting a remote service center for reporting problems and diagnostic information provided by indicators on the pressure washer.

In accordance with a feature of the invention, a diagnostic circuit 36 is provided in the electrical pressure washer 10 for detecting operating conditions of the pressure washer, and a diagnostic indication panel 38 is provided with indicator lights 39 to indicate the detected operation conditions for viewing by the user. The diagnostic indication panel 38 allows the user to see easily the operating conditions of the washer, so that the user can take proper corrective actions based on the diagnostic information shown by the indicator lights. For instance, if an indicator light shows that the GFCI 20 is tripped, the user can correct the problem easily by resetting the GFCI. Information about which action to take based on which indicator light is on or off may be provided in a trouble shooting chapter in the user's manual for the pressure washer. Even if the user lacks the technical knowledge to understand the meaning of the indicator lights or to follow the instructions in the manual to correct the problems, the indicator lights allows the user to report the problem to a remote service center, which can then identify the possible causes of the problem based on the status of the indicator lights. For instance, as shown in FIG. 3, the user 40 can contact a service center 42 of the manufacturer via telephone and tells the service representative 43 the On/Off states of the indicator lights in the diagnostic indicator panel 38 of the pressure washer. Based on that information, the service representative 43 can make a decision or informed guess of what the cause of the problem may be, and give the user instructions over the telephone to try various corrective measures to change the operation conditions to put the pressure washer back in the normal operation mode. In this way, the user 40 can have the problem corrected easily and promptly. As a result, the user is much less likely to unnecessarily return the machine to the shop, send the machine in for repair, or call for a visit by a service person. The contacts between the user 40 and the service center 42 is, of course, not limited to a telephone conversation and can be made via, for example, e-mail or video conferencing over the Internet, or other forms of remote communications.

To protect the diagnostic circuit 36 from exposure to water or other elements, the diagnostic circuit is mounted inside the housing 11 of the pressure washer. The diagnostic circuit 36 operates indicator lights 39 in the diagnostic indication panel 38, which is mounted on the housing at a location that is easily viewable but well protected from accidental impact. In the embodiment shown in FIG. 1, the diagnostic indication panel 38 is located on the upper front surface of the housing adjacent a handle 15 of the pressure washer. The indicator panel 38 includes lights for indicating, for example, the presence of the AC power at the GFCI plug, the AC voltage seen by the motor, whether the over-temperature protection for the motor is on, whether the pressure washer is in the chemical suction mode, etc. Indicators for other types of operation conditions may also be included.

Figure 4:
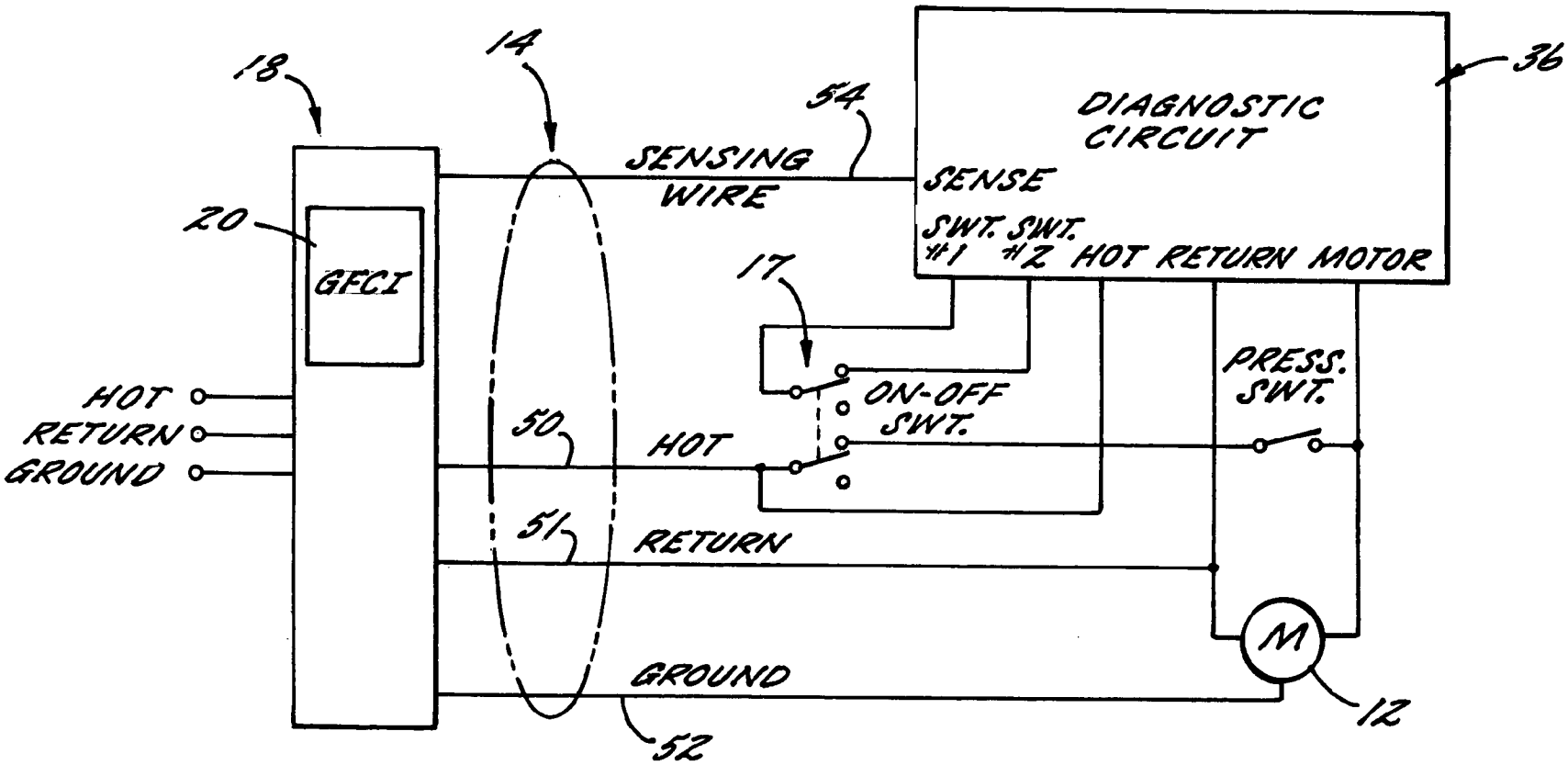
FIG. 4 is a schematic diagram showing a power cord of an embodiment of the pressure washer with a plug having a built-in ground fault circuit interrupter (GFCI) and wiring for markets where GFCI is not required.

In accordance with a feature of a preferred embodiment, the amount of electrical current drawn by the motor 12 of the pressure washer is detected and used to determine several operation conditions of the pressure washer. To that end, in accordance with another feature of the embodiment, the amount of the electrical current is determined by detecting the voltage drop across one of the power conductors in the power cord 14. In the illustrated embodiment, the voltage drop is measured across the Return wire of the power cord. As shown in FIG. 4, the plug 18 with integral GFCI receives the Hot, Return, and Ground components of the standard AC voltage (e.g., 120V) from a wall outlet or the like. On the other side of the plug, the power cord 14 connecting the plug to the pressure washer main body includes a Hot wire 50, a Return wire 51, and a Ground wire 52. The voltage drop across the Return wire 51 provides a useful indication of the current drawn by the motor 12. For instance, as measured on one pressure washer, a 36.5-foot Return wire of 16 AWG has a resistance of about 0.173 ohm. With a current draw of 9-17 Amps, a voltage drop of about 1.5-3 Vrms is created over the Return wire. The detected voltage drop over the Return wire 51 divided by the known resistance of the wire provides the amount of current flowing through the wire.

To measure the voltage drop over the Return wire 51 of the power cord, a sensing wire 54 is added to the standard three wires 50-52 of the power cord 14 and runs along the three wires. Thus, the power cord 14 now contains four wires: Hot, Return, Neutral, and the sensing wire. The sensing wire 54 allows the diagnostic circuit 36 to detect the voltage on the Return wire at the remote plug end of the power cord.

Figure 5:
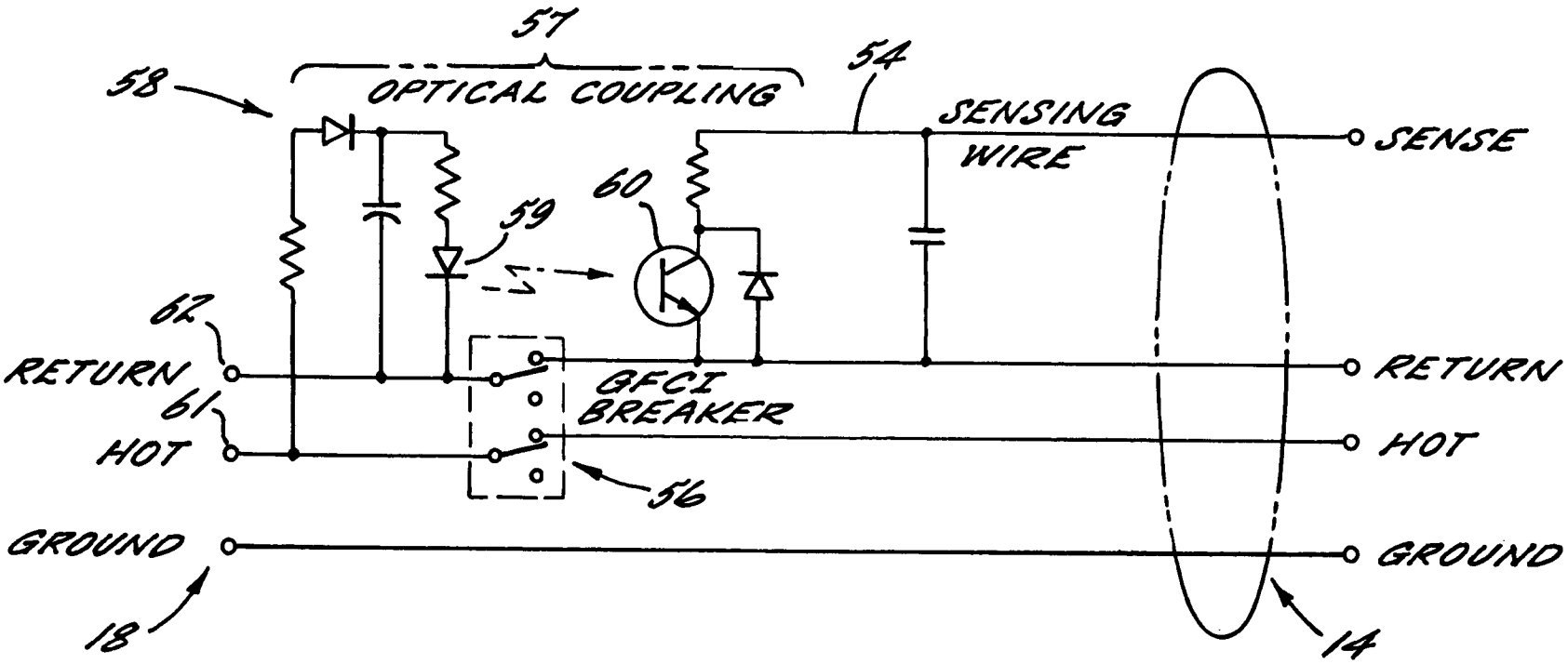
FIG. 5 is a schematic diagram showing an optically coupled sensing circuit over a breaker of the GFCI for sensing whether AC power is present at the plug.

Turning to FIG. 5, the sensing wire further allows the diagnostic circuit 18 to detect whether the AC power is present at the plug 18 before the GFCI breaker 56. Since for safety reasons the sensing wire 54 should not have a direct electrical contact with the plug input upstream of the GFCI breaker 56, an optical coupling assembly 57 is used to sense the presence of AC power. As shown in FIG. 5, a light emitting circuit 56 comprising a simple power supply and a light-emitting diode (LED) 59 is connected across the Hot terminal 61 and Return terminal 62 at the input end of the plug 18. When AC power is present at the plug upstream of the GFCI, the LED 59 is energized to emit light. On the other side of the GFCI breaker 56, the sensing wire 54 is connected to a phototransistor 60 that is positioned to receive the light generated by the LED 59. If the LED 59 is on, the phototransistor 60 is turned on by the light received from the LED. On the other hand, if the LED 59 is off due to the absence of an AC voltage between the Hot and Return terminals 61 and 62, the phototransistor 60 is off. Based on the on/off state of the phototransistor 60 as sensed through the sensing wire 54, the diagnostic circuit 18 can decide whether AC power is present at the plug input.

Figure 6:
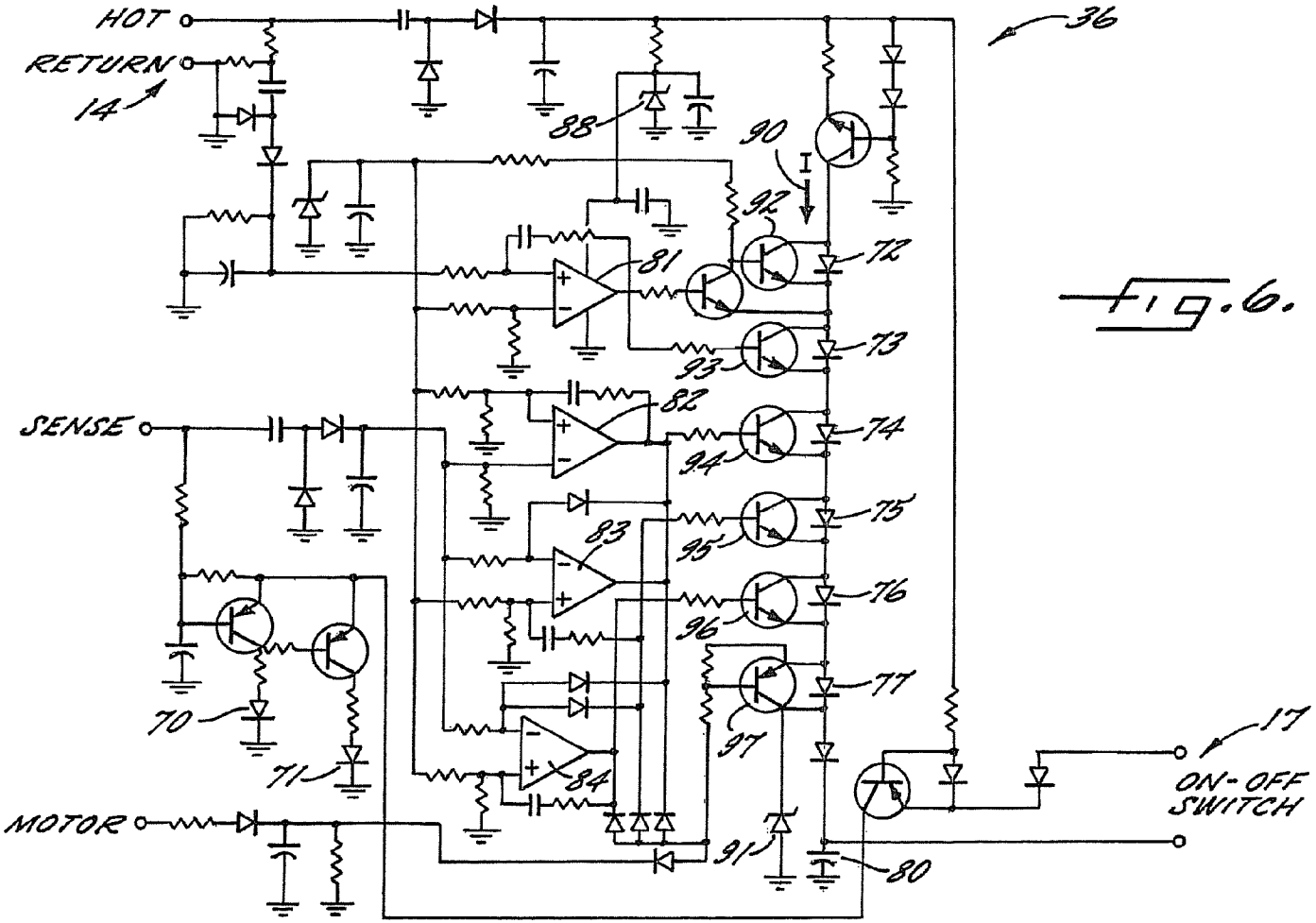
FIG. 6 is an electronic circuit schematic diagram showing a diagnostic circuit in the pressure washer for detecting operation conditions of the pressure washer and operating light-emitting diodes to indicate the detected operation conditions.

Referring now to FIG. 6, the detection of the presence of AC power at the plug before the GFCI in turn allows the diagnostic circuit to determine whether the GFCI breaker 56 is open. If AC power is present at the plug but not at the motor, the diagnostic circuit 18 can deduce that the GFCI breaker 56 is open, and can indicate this condition by turning on an indicator light 70 marked "Check GFCI." On the other hand, if no AC power is detected at the plug input, the diagnostic circuit turns on a "No AC" indicator light 71 to indicate that there is no AC power. This condition may occur if, for instance, the user forgets to connect the plug to a wall outlet or if a circuit breaker before the wall outlet is open.

To power the diagnostic indication assembly so that the indicators can be used to indicate the operation conditions even after the AC power is cut off, a backup capacitor 80 of a sufficiently large value (e.g., 0.1 farad) is used in the diagnostic circuit to store energy. If the On/Off switch 17 on the pressure washer is in the On position but the AC power to the pressure washer is cut off, the capacitor 80 is automatically switched in to power the components of the diagnostic circuit 36.

To reduce the energy consumption of the diagnostic indication assembly that includes the diagnostic circuit and the indication panel, light-emitting diodes (LED's) are used as the indicator lights. In the illustrated embodiment, the diagnostic circuit includes LED's 70-77 that are marked respectively on the display panel (FIG. 1) as "Check GFCI," "No AC Power," "AC OK," "AC Low," "Motor OK," "Detergent ON," "Low Water Flow," and "Motor Over-temperature," respectively.

To simplify the control logic of the diagnostic circuit 36 and to reduce the cost for implementing the circuitry, low-cost operational amplifies (OpAmp) 81-84 are used to detect the different operation conditions. The OpAmps 81-84 are of a low-power type to further reduce the power consumption of the diagnostic circuit. The OpAMps 81-84 are connected to respective indicator LED's 72-76 to selectively turn the LED's on or off depending on the operation conditions detected. In the implementation of FIG. 6, the OpAmps 81-84 are used basically as voltage comparators. Each OpAmp compares an input voltage with a reference voltage (via appropriate voltage dividers), which is provided by a zener diode 88 (DIODE 16) in the circuit of FIG. 6. The input voltage for each OpAmp is a voltage derived from voltages detected in the electrical system of the pressure washer. Such detected voltages include the AC power voltages and, as mentioned above, the voltage drop over the Return wire as detected through the sensing wire.

In accordance with a feature of the embodiment, the voltage detected through the sensing wire enables the determination of multiple operation conditions. As already described above, the sensed voltage at the plug end of the power cord 14 is used together with the voltage detected at the motor to determine whether there is no AC power at the plug 18 or the GFCI breaker 56 may be open. In the circuit of FIG. 6, the voltage drop over the Return wire is further used to determine whether the motor is in normal operation condition (i.e., "Motor OK"), whether the pressure washer is in the chemical suction mode (i.e., "Detergent On"), whether the inlet water pressure is low (i.e., "Low Water Flow"), or whether the thermal protection circuit for the motor is opened to prevent the motor from overheating (i.e., "Motor Over-temperature"). As described above, the voltage drop over the Return wire can be used to determine the root mean square (rms) value of the current following through the motor 12 of the pressure washer. It has been experimentally discovered in connection with this invention that the root mean square values of the current drawn by the motor 12 corresponding to these four operation conditions fall into four separate ranges. When the pressure washer is operating normally, the motor current stays in a high-current range, and varies depending to different degrees on the AC rms voltage at the motor, the type of nozzle used, and the shape of the output water stream at the nozzle. When the pressure washer is in the chemical suction mode, the motor current is significantly lower than that of the normal operation. When the inlet water pressure is low, the low water flow causes the motor current to fluctuate rapidly, but the averaged value of the motor current is fairly stable and stays below the motor current in the chemical suction mode, thus providing a good indication of the presence of the low inlet pressure condition. When the thermal protection circuit in the motor winding is opened, the motor is not drawing any current. The lack of motor current together with the detection that the AC voltage is detected at the motor indicates that the thermal protection circuit in the motor may be opened.

In according with another feature of the embodiment, to minimize the current required to operate the LED's, the LED's 72-77 are connected in series such that the same current (hereinafter "the indicator current") can flow through selected LED's to turn those LED's on. The efficiency of power usage is further enhanced by using the indicator current 90 to charge the backup capacitor 80 by connecting the capacitor in series to the chain of LED's. During operation, when the AC power is available, the indicator current flows through one or more of the LED's 72-77 depending on the operation conditions detected by the OpAmps 81-84, and flows into the backup capacitor 80 to charge the capacitor until the voltage across the capacitor reaches a value set by the zener diode 91. When the AC power is cut off, the energy stored in the backup capacitor 80 is used to power the operation of the diagnostic circuit 36 to turn either of the LED's 70 and 71 on to indicate to the user that the GFCI should be checked or there is no AC power at the plug 18.

To control the On/Off state of each of the LED's 72-77, a plurality of bypass transistors 92-97 are provided such that each LED has a corresponding bypass transistor connected in parallel therewith. When the bypass transistor is turned on, the indicator current will flow through the bypass transistor instead of the LED. As a result, the LED is turned off, i.e., it does not emit light. The On/Off state of the bypass transistor is controlled by an associated OpAmp depending on whether the operating condition monitored by that OpAmp is present. By way of example, if the pressure washer is being used and the motor 12 is running normally, the voltage drop over the Return wire is of a value indicating that the motor current is in the high range. The voltage drop is presented as one of the input voltages for the OpAmp 82. The other input voltage is derived from the reference voltage via a voltage divider. The input voltages for the OpAmp 82 cause the output voltage of the OpAmp to be at a low value that turns the bypass transistor 94 off. With the bypass transistor 94 turned off, the indication current flows through the LED 74. As a result, the LED 74 generates light to indicate that the motor is operating normally.

Figure 7:
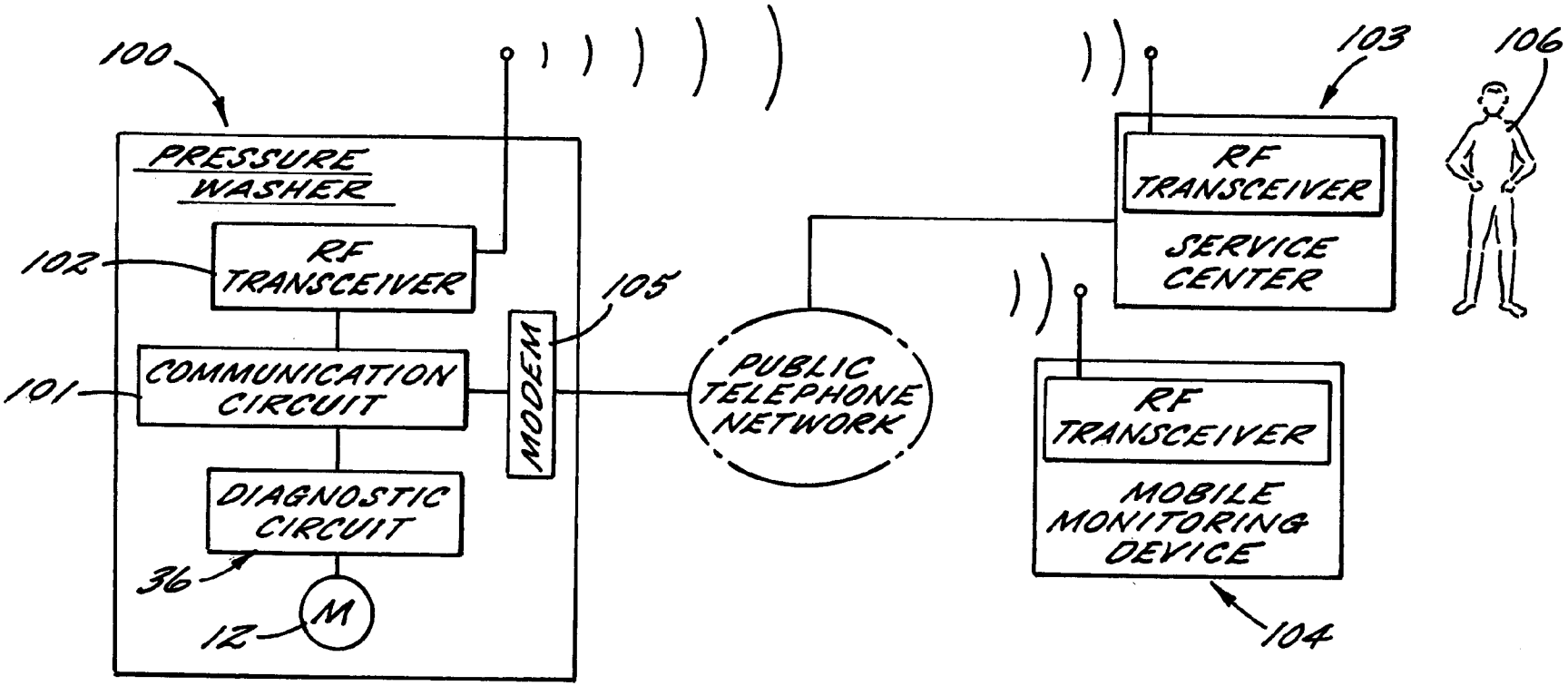
FIG. 7 is a schematic diagram showing a pressure washer of an embodiment that transmits RF signals for wireless communication with a monitoring device.

In an alternative embodiment as shown in FIG. 7, a pressure washer 100 is equipped with a communication circuit 101. The communication circuit controls a radio frequency (RF) transceiver 102 to send and receive radio frequency signals. The wireless communication capability of the pressure washer 100 can be used for various purposes. For instance, the RF communication circuit may serve the function of a tracking device. To that end, the communication circuit may be programmed to transmit the serial number of the pressure washer, and/or other information that may be used to identify the pressure washer. The RF transmission may be received by a receiver at a service center 103, or by a mobile monitoring device 104. Moreover, the RF transmission may also include diagnostic data indicative of the operation conditions detected by the diagnostic circuit 36. This enables the receiver of the RF transmission from the machine to determine the status of the pressure washer in the field and, if necessary, to contact the user of the pressure washer to correct the problem to restore the normal operation of the washer.

Alternatively, the pressure washer may be equipped with a modem 105. The communication circuit 101 is programmed such that it automatically dials up to a pre-programmed number of the service center 103 when the modem is plugged into a telephone line. Once the phone connection is made, the communication circuit 101 transmits information including the serial number of the pressure washer and the operation conditions. This enables a service technician 106 at the service center 103 to identify the potential problems of the unit without having to physically examine the machine.

Figure 8:
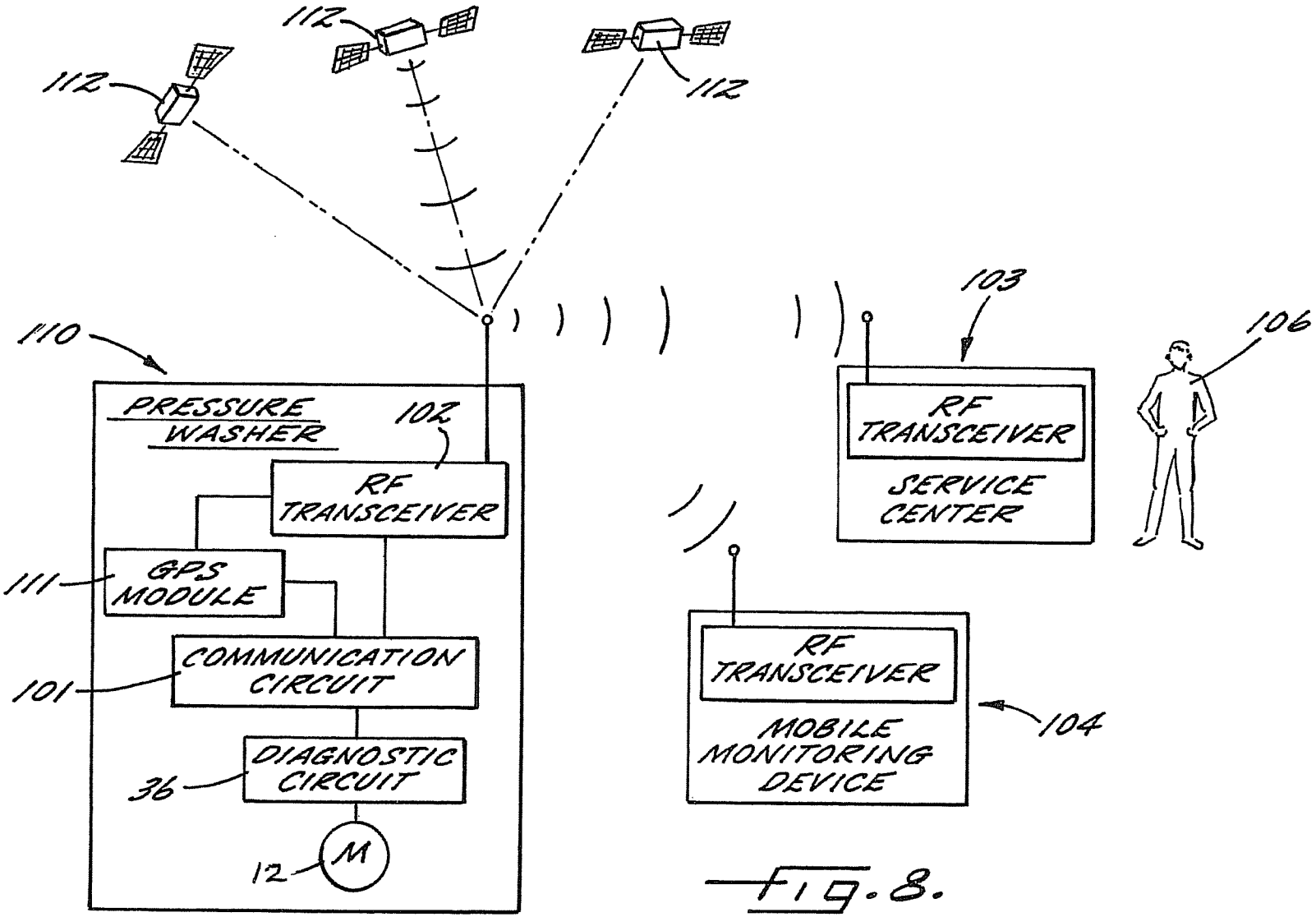
FIG. 8 is a schematic diagram showing a pressure washer of another embodiment that has a global positioning system module.

In yet another embodiment as shown in FIG. 8, the pressure washer 110 is further equipped with a global positioning system (GPS) module 111. The GPS module 111 receives radio signals from GPS satellites 112. By triangulation of signals from three of the GPS satellites 112 the GPS module 111 can pinpoint its current location. The communication circuit 101 of the pressure washer 110 then transmits RF signals containing information of its current location, its identification, and its operational status as detected by the diagnostic circuit 36. The transmission and reception of the RF signals may utilize the infrastructure provided by a cellular phone network. When the RF signals is received by the service station 103 or a mobile monitoring unit 104, the service technician 106 can learn the identity of the pressure washer, where the machine is, and whether the machine is operating properly. Thus, if the pressure washer 110 is left in the field or is stolen, the RF transmission sent by the communication circuit 101 of the pressure washer can be used to track the location of the pressure washer, and the identification information encoded in the transmission allows the receiver to identify the pressure washer. The identification information in the wireless transmission also allows the monitoring device to remotely monitor the inventory of pressure washers at a store. To that end, the GPS locator function of the machine may be activated at the time the pressure washer 110 is purchased by a customer at a store. The GPS locating transmission from the pressure washer 10 may also be triggered in response to commands sent remotely by the service center 103 over RF transmission.

In view of the many possible embodiments to which the principles of this invention may be applied, it should be recognized that the embodiments described herein with respect to the drawing figures are meant to be illustrative only and should not be taken as limiting the scope of the invention. Therefore, the invention as described herein contemplates all such embodiments as may come within the scope of the following claims and equivalents thereof.

What is claimed is:

1. An electrical pressure washer comprising:

a housing including a water inlet port and a water outlet port;

the housing containing an electrical motor that is adapted to pressurize water received through the water inlet port and to output pressurized water through the water outlet port;

an application wand connected to the water outlet by a hose and having a nozzle for outputting the pressurized water;

the housing further including a diagnostic circuit and an indication panel;

a power cord connected to the electrical motor for delivering AC power to the electrical motor and having a plug at a distal end;

wherein the diagnostic circuit includes a plurality of operational amplifiers, each operational amplifier determining the presence of a different operation condition of the pressure washer based on a comparison between a detected voltage drop over a return wire of the power cord and a corresponding reference voltage;

wherein the indication panel comprises a plurality of indicator lights that are connected to the diagnostic circuit, with each indicator light each corresponding to said different operation condition and being adapted to be illuminated when the diagnostic circuit has determined that the respective operation condition is present.

2. The electrical pressure washer of claim 1, wherein one of the respective operation conditions is that the electrical motor is operational.

3. The electrical pressure washer of claim 1, wherein one of the respective operation conditions is that a water pressure at the water input port is low.

4. The electrical pressure washer of claim 1, further comprising a chemical tank for storing a liquid detergent, and wherein one of the respective operation conditions is that the pressure washer is in a mode of extracting the liquid detergent from the chemical tank for mixing with water received through the inlet port.

5. The electrical pressure washer of claim 1, wherein one of the respective operation conditions is that a thermal protection circuit of the electrical motor is open for protecting the electrical motor from overheating.

6. The electrical pressure washer of claim 1, wherein one of the respective operation conditions is that an AC voltage at the electrical motor is low.

7. The electrical pressure washer of claim 1, wherein the plug of the power cord includes a ground fault circuit interrupter.

8. The electrical pressure washer of claim 1, further including a sensing wire connecting the diagnostic circuit to the distal end of the power cord for detecting the voltage drop over the return wire of the power cord.

9. The electrical pressure washer of 8, further comprising a ground fault circuit interrupter, wherein the diagnostic circuit further detects whether a breaker of the ground fault circuit interrupter is open.

10. The electrical pressure washer of claim 9, wherein the diagnostic circuit further detects whether an AC voltage is present at the plug before the ground fault circuit interrupter.

11. The electrical pressure washer of claim 1, wherein the plurality of indicator lights are light emitting diodes.

12. The electrical pressure washer of claim 11, wherein a subgroup of the light emitting diodes are wired in series.

13. The electrical pressure washer of claim 12, wherein each light emitting diode in the subgroup has a bypass transistor connected in parallel with said each light emitting diode for selectively diverting current away from said each light emitting diode.

14. The electrical pressure washer of claim 13, wherein the diagnostic circuit includes a backup capacitor for powering the diagnostic circuit in absence of AC power, and wherein the backup capacitor is connected in series to the light emitting diodes in the subgroup such that a current for energizing the light emitting diodes also charges the backup capacitor.

15. An electrical pressure washer comprising:

a water inlet port for receiving water from a water source;

a water outlet port;

an electrical motor in fluid communication with the water inlet port and the water outlet port for pressurizing the water received through the water inlet port and pumping the pressurized water through the water outlet port;

an application wand connected to the water outlet by a hose and having a nozzle for outputting a pressurized water stream;

a power cord having a plug at a distal end for connecting AC power to the electrical motor;

a diagnostic circuit for detecting a voltage drop over the power cord and determining an operation condition based on the voltage drop;

an indication panel having at least one indicator light for indicating the operation condition;

a sensing wire connecting the diagnostic circuit to the distal end of the power cord for detecting the voltage drop over the power cord;

a ground fault circuit interrupter, wherein the diagnostic circuit further detects whether a breaker of the ground fault circuit interrupter is open;

wherein the diagnostic circuit further detects whether an AC voltage is present at the plug before the ground fault circuit interrupter; and wherein the plug further includes a light emitter on an input end of the plug and an optical receiver connected to the sensing wire, the light emitter emitting light when an AC voltage is present at the plug.

16. An electrical device comprising:

an electrical motor;

a sensing circuit;

a power cord having a plug at a distal end for connecting AC power to the electrical motor, the power cord having a Hot wire, a Return wire, a Ground wire, and a sensing wire connected to the sensing circuit for the sensing circuit to detect a voltage at the plug, wherein the plug further includes a light emitter on an input end of the plug and an optical receiver connected to the sensing wire, the light emitter emitting light when an AC voltage is present at the plug, and wherein the plug of the power cord has a ground fault circuit interrupter, wherein the sensing circuit further detects through the sensing wire whether a breaker of the ground fault circuit interrupter is open and whether an AC voltage is present at the plug before the ground fault circuit interrupter;

wherein the sensing circuit senses a voltage drop over the Return wire by detecting the voltage at the plug, the voltage drop being indicative of an amount of current drawn by the electrical motor; and wherein the electrical device is a pressure washer comprising: a water inlet port for receiving water from a water source; a water outlet port, wherein the electrical motor is in fluid communication with the water inlet port and the water outlet port for pressurizing the water received through the water inlet port and pumping the pressurized water through the water outlet port; and an application wand connected to the water outlet by a hose and having a nozzle for outputting a pressurized water stream.

17. The electrical pressure washer of claim 16, wherein the sensing circuit detects an operation condition of the pressure washer based on the voltage drop, and wherein the pressure washer further includes an indication panel having at least one indicator light for indicating the detected operation condition.

18. The electrical pressure washer of claim 16, wherein the operation condition detected by the sensing circuit is that the electrical motor is operational.

19. The electrical pressure washer of claim 17, wherein the operation condition detected by the sensing circuit is that a water pressure at the water input port is low.

20. The electrical pressure washer of claim 17, wherein the pressure washer further includes a chemical tank for storing a liquid detergent, and wherein the operation condition detected by the sensing circuit is that the pressure washer is in a mode of extracting the liquid detergent from the chemical tank for mixing in the water stream.

21. The electrical pressure washer of claim 17, wherein the operation condition detected by the sensing circuit is that a thermal protection circuit of the electrical motor is open for protecting the electrical motor from overheating.

* * * * *